US007607762B2

(12) United States Patent
Katsumura et al.

(10) Patent No.: US 7,607,762 B2
(45) Date of Patent: Oct. 27, 2009

(54) NOZZLE PLATE, METHOD OF MANUFACTURING NOZZLE PLATE, LIQUID DROPLET EJECTION HEAD, METHOD OF MANUFACTURING LIQUID DROPLET EJECTION HEAD, AND IMAGE FORMING APPARATUS

(75) Inventors: Manabu Katsumura, Kanagawa (JP); Shinya Sugimoto, Kanagawa (JP); Tsutomu Yokouchi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 436 days.

(21) Appl. No.: 11/510,576

(22) Filed: Aug. 28, 2006

(65) Prior Publication Data

US 2007/0139483 A1 Jun. 21, 2007

(30) Foreign Application Priority Data

Aug. 30, 2005 (JP) ..... 2005-249729

(51) Int. Cl.
*B41J 2/045* (2006.01)

(52) U.S. Cl. ..... 347/68

(58) Field of Classification Search ..... None
See application file for complete search history.

(56) References Cited

FOREIGN PATENT DOCUMENTS

JP 2004-276568 A 10/2004
JP 2006-056233 * 3/2006

* cited by examiner

*Primary Examiner*—K. Feggins
(74) *Attorney, Agent, or Firm*—Birch, Stewart, Kolasch & Birch, LLP

(57) ABSTRACT

The nozzle plate comprises: a nozzle through which liquid is ejected; a nozzle forming surface in which the nozzle is provided; and a liquid-repellency layer which is provided on the nozzle forming surface, the liquid-repellency layer including a carbon nanotube layer.

10 Claims, 9 Drawing Sheets

POLISHING OF PIEZOELECTRIC BODY

FORMATION OF COMMON ELECTRODE

FORMATION OF DIAPHRAGM

BONDING OF FLOW CHANNEL PLATE

IMPLEMENTATION OF PATTERNING OF PIEZOELECTRIC BODY

FORMATION OF INDIVIDUAL ELECTRODES

BONDING OF NOZZLE PLATE

10 :LIQUID EJECTION HEAD

NOZZLE PLATE, METHOD OF MANUFACTURING NOZZLE PLATE, LIQUID DROPLET EJECTION HEAD, METHOD OF MANUFACTURING LIQUID DROPLET EJECTION HEAD, AND IMAGE FORMING APPARATUS

BACKGROUND OF THE INVENTION

1. Field of the Invention

The present invention relates to a nozzle plate, a method of manufacturing a nozzle plate, a liquid droplet ejection head, a method of manufacturing a liquid droplet ejection head, and an image forming apparatus, and more particularly, to a nozzle plate, a method of manufacturing a nozzle plate, a liquid droplet ejection head, a method of manufacturing a liquid droplet ejection head, and an image forming apparatus suitable for a recording head (print head) which ejects liquid from a nozzle.

2. Description of the Related Art

Image forming apparatuses such as inkjet printers use a liquid droplet ejection head comprising nozzles (nozzle holes) which eject liquid onto an ejection receiving medium, such as paper, pressure chambers connected to the nozzles, and pressurization devices (actuators such as piezoelectric elements) for pressurizing the liquid inside the pressure chambers.

In a liquid droplet ejection head, since liquid is ejected from the nozzles in the form of liquid droplets, the surface properties of the liquid droplet ejection side of the nozzle forming surface of the nozzle plate in which the nozzles are formed (in other words, the surface on the side of the nozzle plate adjacent to the ejection receiving medium, which is also called the "nozzle forming surface" below), have a great influence on the liquid droplet ejection characteristics. For example, if ink adheres to the peripheral regions of the nozzles, then not only does the liquid droplet ejection direction become unstable, but other problems may also arise, such as decrease of the nozzle diameter, reduction of the liquid droplet ejection amount (reduction of the size of the liquid droplets), fluctuation of the liquid droplet ejection speed, and so on. Therefore, technology is known in which a liquid-repellency film (liquid-repellency layer, lyophobic film) is formed on the surface of the nozzle forming surface, thereby preventing adherence of ink to the peripheral regions of the nozzles and hence improving liquid droplet ejection characteristics.

For this liquid-repellency layer, technology is generally used in which an organic thin film having added fluorine, or a fluorine-based lyophobic agent is coated onto the nozzle forming surface, in particular with the object of providing functions for "wear resistance" and "liquid-repellency for stabilizing flight". Furthermore, technology for forming a non-organic thin film with added fluorine is also known. However, if such a nozzle forming surface is used for a long period of time, or wiped repeatedly, or the like, the fluorine is removed and the liquid-repellency layer degrades, thereby reducing the liquid droplet ejection characteristics.

In order to resolve this, Japanese Patent Application Publication No. 2004-276568 discloses a nozzle forming surface where detachment of the liquid-repellency layer is prevented by forming a thin film layer made of diamond-like carbon (DLC) having excellent adhesive properties with respect to the nozzle plate, and a DLC layer with added fluorine is formed as a liquid-repellency layer so that liquid-repellency is imparted to the nozzle forming surface. The DLC layer with added fluorine in Japanese Patent Application Publication No. 2004-276568 has two or more layers of different added amounts of fluorine, whereby the added amount of fluorine is reduced on the layer adjacent to the DLC, and the added amount of fluorine is increased, the nearer the position to the surface. Thereby, good liquid-repellency is achieved, and even if a certain amount of fluorine becomes detached from the layer where the added amount of fluorine is larger at the surface, then since there is a large added amount of fluorine, it is possible to maintain the liquid-repellency.

DLC is a general term for a carbon thin film which are synthesized by vapor phase synthesis using ions, or the like, and which has properties similar to those of diamond, for example, high hardness, electrical insulating properties, infrared transmissivity, and the like. Therefore, the liquid-repellency layer described in Japanese Patent Application Publication No. 2004-276568 is strongly resistant to shocks caused by rubbing during wiping, or the like, but it is liable to suffer cracking or chipping in response to any mechanical impacts that may arise during paper jams, maintenance operations, or the like.

Furthermore, if there is a difference in the coefficient of linear expansion between the flow channel substrate (namely, the plate having ink flow channels comprising pressure chambers and the like) which is attached to the nozzle plate, and the nozzle plate itself, then a tensile stress or compressive stress arises between the flow channel substrate and the nozzle plate when the temperature rises during manufacturing, for example, and hence bending of the nozzle plate may occur. Moreover, if the material of the nozzle plate is an organic film, such as polyimide, then the organic film itself swells due to absorption of the ink, and the nozzle plate may suffer bending. Consequently, there is a possibility that the DLC may break off from the surface of the nozzle plate.

SUMMARY OF THE INVENTION

The present invention is contrived in view of aforementioned circumstances, an object thereof being to provide a nozzle plate, a method of manufacturing a nozzle plate, a liquid droplet ejection head, a method of manufacturing a liquid droplet ejection head, and an image forming apparatus, in which a liquid-repellency layer having excellent durability and liquid repellency is provided on the nozzle forming surface.

In order to attain the aforementioned object, the present invention is directed to a nozzle plate comprising: a nozzle through which liquid is ejected; a nozzle forming surface in which the nozzle is provided; and a liquid-repellency layer which is provided on the nozzle forming surface, the liquid-repellency layer including a carbon nanotube layer.

According to this aspect of the present invention, since a liquid-repellency layer comprising a carbon nanotube layer is formed on the nozzle forming surface, then a liquid-repellency layer is obtained which has a structure in which a large number of carbon nanotubes are packed densely in the form of a brush, and therefore, a nozzle plate having a liquid-repellency layer with good wear resistance and toughness can be formed.

The liquid-repellency layer is required to have both of a wear resistance for preventing the hardness from being reduced as a wear resistance member, and a toughness for preventing it from suffering cracking or chipping as a result of mechanical impacts. However, in general, the greater the hardness, the lower the toughness; and hence the hardness and toughness of a material have a mutually incompatible relationship. Nevertheless, the carbon nanotube layer has good tensile strength due to its crystalline structure, and sufficient softness to revert readily to its original shape when deformed, and hence the carbon nanotube layer is able to absorb mechanical impacts.

Furthermore, since the carbon nanotube layer comprises independent carbon nanotubes grown in the form of a brush, then if there is bending of the nozzle plate, the carbon nanotube layer can bend with the nozzle plate. Therefore, it is possible to prevent the carbon nanotube layer from peeling away and becoming detaching from the nozzle plate.

On the other hand, in terms of liquid-repellency, since the carbon nanotube layer comprises carbon nanotubes packed densely in the form of a brush in a perpendicular direction with respect to the nozzle plate, in accordance with the inherent orientation of the nanotubes. Accordingly, the structure of the deposited carbon nanotube layer has very slight undulations. Each individual carbon nanotube has liquid-repellency itself, and in addition to this, the liquid-repellent effects are further enhanced by the undulating structure. The liquid-repellent effects can be maintained as long as the carbon nanotube layer has an undulating structure.

In this way, since a carbon nanotube layer is used as the liquid-repellency layer, the wear resistance characteristics are good in comparison with a liquid-repellency film made of a thin organic film containing fluorine, and the liquid-repellency layer has good toughness in comparison with a DLC thin film.

The "nozzle forming surface" in the present specification means the liquid droplet ejection side of the nozzle forming surface of the nozzle plate, in other words, the surface of the nozzle plate which is nearer to the ejection receiving medium.

Preferably, the carbon nanotube layer is deposited by chemical vapor deposition of carbon nanotubes on a metal catalyst layer including at least one of iron, nickel and cobalt.

According to this aspect of the present invention, since at least one of iron, nickel, or cobalt is adopted as a material of the metal catalyst layer, it is possible to obtain a metal catalyst layer which is favorable for depositing carbon nanotubes. In particular, since the carbon nanotubes are formed by chemical vapor deposition on the metal catalyst layer, then the tensile strength of the boundary regions between the metal catalyst layer and the carbon nanotubes can be increased in comparison with a case where the liquid-repellency layer is bonded to the nozzle plate by adhesive, or the like, for example. Furthermore, since the carbon nanotubes can be grown by chemical vapor deposition, provided that a metal catalyst layer can be formed, then even in the case of a long line head, or the like, in which it is difficult to deposit a uniform liquid-repellency layer, for example, it is still possible to obtain a uniform liquid-repellency layer according to the present invention.

In order to attain the aforementioned object, the present invention is also directed to a method of manufacturing a nozzle plate comprising a nozzle through which liquid is ejected and a nozzle forming surface in which the nozzle is provided, the method comprising the steps of: forming a metal catalyst layer on the nozzle forming surface of the nozzle plate; and depositing carbon nanotubes by chemical vapor deposition, onto the metal catalyst layer.

According to this aspect of the present invention, since a catalyst layer forming step for forming a metal catalyst layer on the nozzle forming surface of the nozzle plate, and a CVD step for forming carbon nanotubes by chemical vapor deposition on the metal catalyst layer are included, then it is possible to deposit a carbon nanotube layer.

Preferably, the metal catalyst layer is formed selectively in a section where the nozzle is not formed on the nozzle forming surface of the nozzle plate.

According to this aspect of the present invention, since the metal catalyst layer is formed selectively in a section where a nozzle is not formed on the nozzle forming surface of the nozzle plate, then it is possible to form the metal catalyst layer only on the region of the surface of the nozzle plate apart from the region where the nozzle is not formed, and hence a carbon nanotube layer can be formed only in a desired region.

In order to attain the aforementioned object, the present invention is also directed to a liquid droplet ejection head comprising a nozzle plate, wherein the nozzle plate includes: a nozzle through which liquid is ejected; a nozzle forming surface in which the nozzle is provided; and a liquid-repellency layer which is provided on the nozzle forming surface, the liquid-repellency layer including a carbon nanotube layer.

According to this aspect of the present invention, since a liquid-repellency layer comprising a carbon nanotube layer is formed on the nozzle forming surface of the nozzle plate, in other words, on the surface of the nozzle plate which is nearer to the ejection receiving medium, then a liquid-repellency layer is obtained which has a structure in which a large number of carbon nanotubes are packed densely in the form of a brush, and therefore, a liquid droplet ejection head having a liquid-repellency layer with good wear resistance and toughness can be formed.

The carbon nanotube layer has good tensile strength due to its crystalline structure, and sufficient softness to revert readily to its original shape when deformed, and therefore it is able to absorb mechanical impacts.

Furthermore, even if there is bending of the nozzle plate, since the carbon nanotube layer can bend with the nozzle plate, it is possible to prevent the carbon nanotube layer from peeling away or becoming detached from the nozzle plate.

On the other hand, since the deposited carbon nanotube layer has a very slightly undulating structure, the liquid-repellent effects are enhanced by this undulating structure.

Preferably, the carbon nanotube layer is deposited by chemical vapor deposition of carbon nanotubes on a metal catalyst layer including at least one of iron, nickel and cobalt.

According to this aspect of the present invention, since at least one of iron, nickel, or cobalt is adopted as a material of the metal catalyst layer, it is possible to obtain a metal catalyst layer which is good for depositing carbon nanotubes. In particular, since the carbon nanotubes are formed by chemical vapor deposition on the metal catalyst layer, then the tensile strength of the boundary regions between the metal catalyst layer and the carbon nanotubes can be increased in comparison with a case where the liquid-repellency layer is bonded to the nozzle plate by adhesive, or the like, for example. Furthermore, since the carbon nanotubes can be grown by chemical vapor deposition, provided that a metal catalyst layer can be formed, then even in the case of a long line head, or the like, in which it is difficult to deposit a uniform liquid-repellency layer, for example, it is still possible to obtain a uniform liquid-repellency layer according to the present invention.

In order to attain the aforementioned object, the present invention is also directed to a method of manufacturing a liquid droplet ejection head comprising a nozzle plate including a nozzle through which liquid is ejected and a nozzle forming surface in which the nozzle is provided, the method comprising the steps of: forming a metal catalyst layer on the nozzle forming surface of the nozzle plate; and depositing carbon nanotubes by chemical vapor deposition, onto the metal catalyst layer.

According to this aspect of the present invention, since a catalyst layer forming step for forming a metal catalyst layer on the nozzle forming surface of the nozzle plate, and a CVD step for forming carbon nanotubes by chemical vapor deposition on the metal catalyst layer are included, then it is possible to deposit a carbon nanotube layer.

Preferably, the metal catalyst layer is formed selectively in a section where the nozzle is not formed on the nozzle forming surface of the nozzle plate.

According to this aspect of the present invention, since the metal catalyst layer is formed selectively in a section where a nozzle is not formed on the nozzle forming surface of the nozzle plate, then it is possible to form the metal catalyst layer only on the region of the surface of the nozzle plate apart from the region where the nozzle are not formed, and hence a carbon nanotube layer can be formed only in a desired region.

Preferably, the method further comprises a step of bonding the nozzle plate to a substrate including a pressure chamber in such a manner that the pressure chamber is connected with the nozzle.

According to this aspect of the present invention, since the nozzle plate is bonded while the pressure chamber is connected with the nozzle, then when the nozzle plate provided with a carbon nanotube layer is bonded to a substrate, the bonding position of the nozzle plate can be determined with respect to the substrate.

Here, the "substrate" indicates a flow channel structure body (flow channel substrate) including a pressure chamber, a connection channel, a supply channel, a common liquid chamber, and the like.

In order to attain the aforementioned object, the present invention is also directed to an image forming apparatus comprising a liquid droplet ejection head including a nozzle plate, wherein the nozzle plate comprises: a nozzle through which liquid is ejected; a nozzle forming surface in which the nozzle is provided; and a liquid-repellency layer which is provided on the nozzle forming surface, the liquid-repellency layer including a carbon nanotube layer.

According to this aspect of the present invention, since a liquid-repellency layer comprising a carbon nanotube layer is formed on the nozzle forming surface of the nozzle plate, in other words, the surface of the nozzle plate which is nearer to the ejection receiving medium, then a liquid-repellency layer is obtained which has a structure in which a large number of carbon nanotubes are packed densely in the form of a brush, and therefore, an image forming apparatus having a liquid-repellency layer with good wear resistance and toughness can be formed.

In the specification of the present invention, the term "liquid" includes all liquids which can be ejected from a nozzle in the form of a liquid droplet, such as ink, resist and other liquid chemicals, treatment liquid, water, and the like.

Furthermore, the member in which a hole that is to become a nozzle (nozzle hole) is formed is called a "nozzle plate", and the term "nozzle" is used to cover both this nozzle hole and a hole in the liquid-repellency layer.

According to the present invention, since a liquid-repellency layer comprising a carbon nanotube layer is provided on the nozzle forming surface, then it is possible to achieve a liquid-repellency layer having excellent durability and liquid-repellency.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
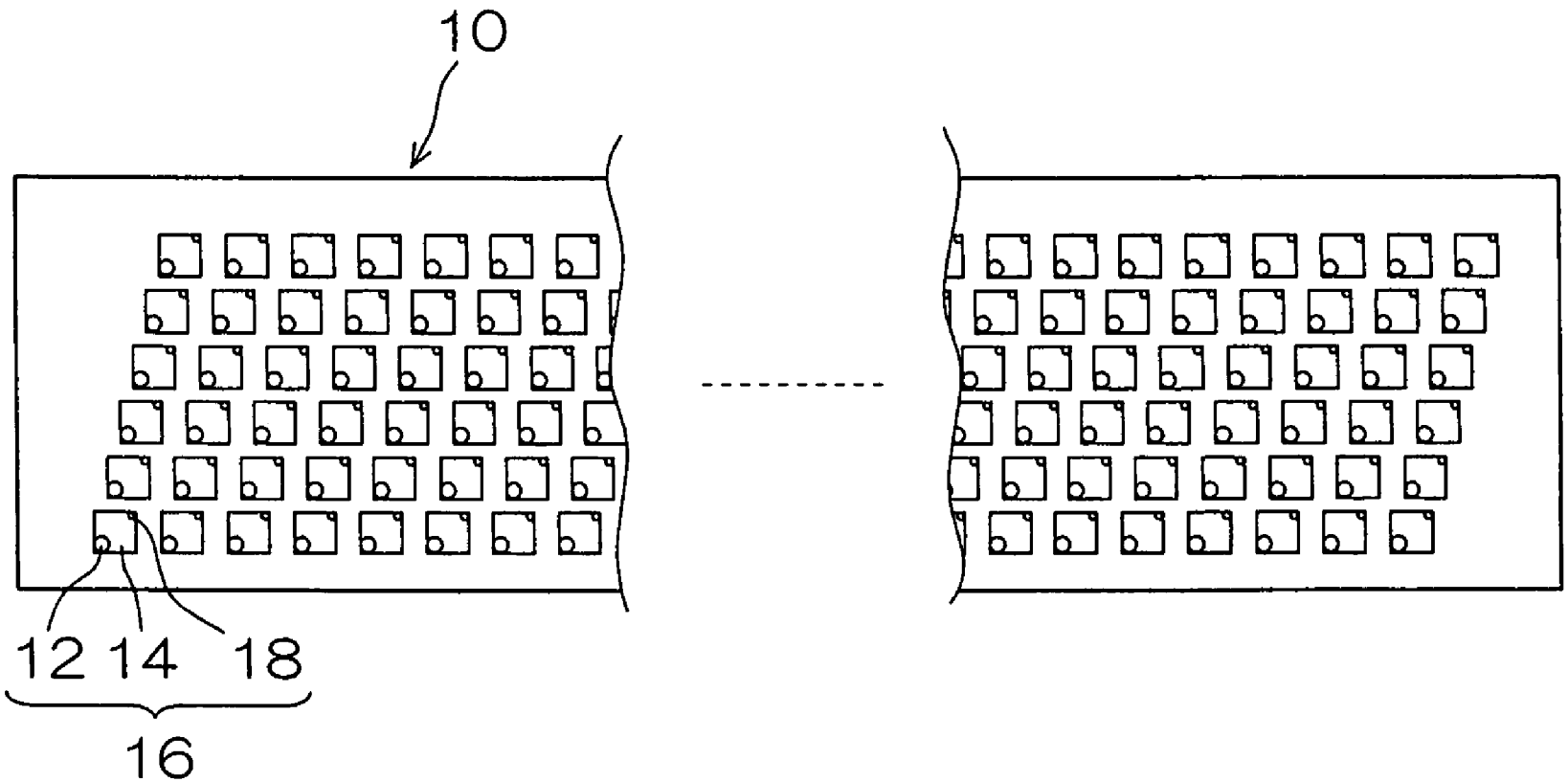
FIG. 1 is a plan view perspective diagram showing a schematic drawing of the structure of a liquid droplet ejection head relating to an embodiment of the present invention.
Figure 2:
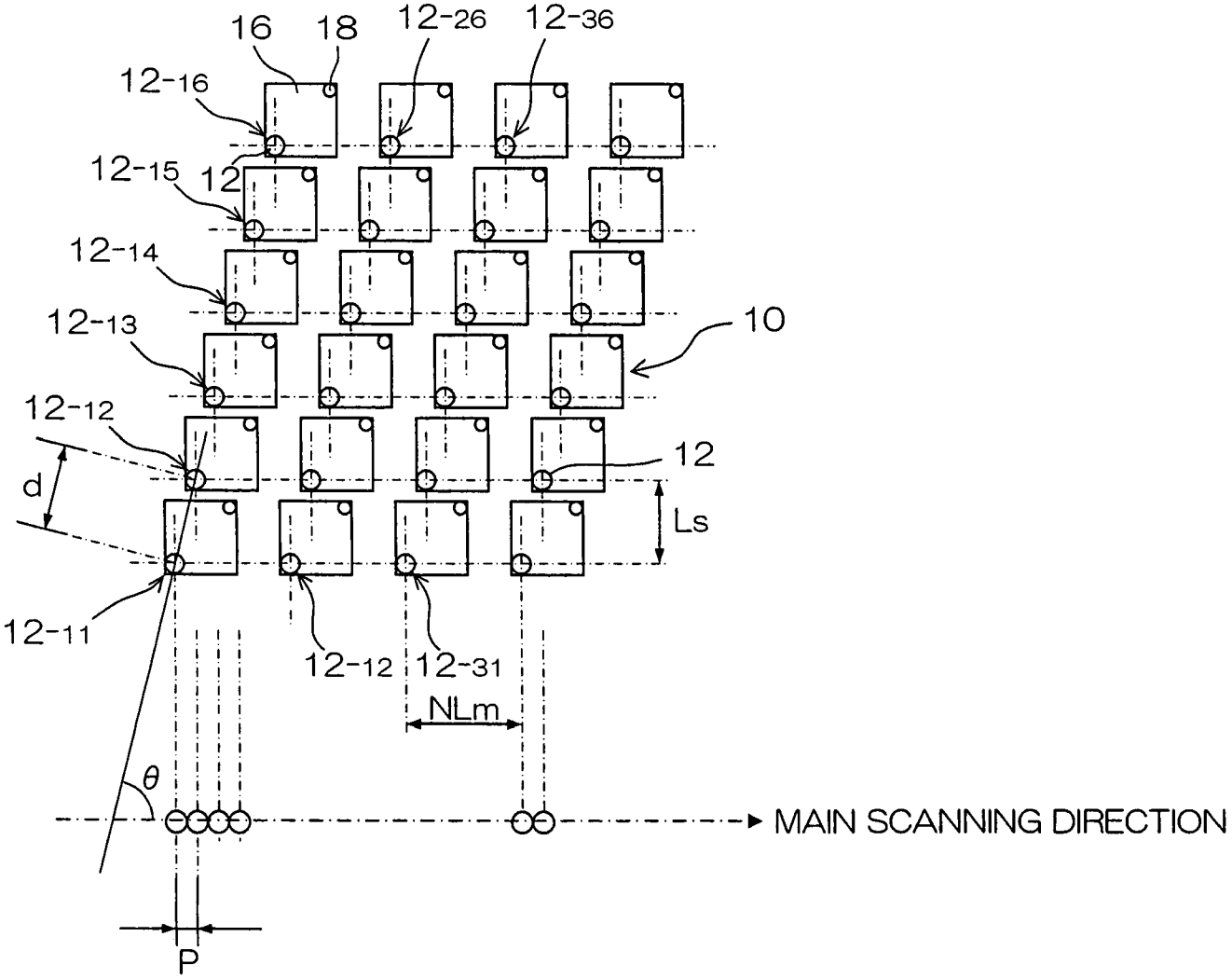
FIG. 2 is a partial enlarged view of FIG. 1.

FIG. 1 is a plan view perspective diagram showing a schematic view of the structure of a liquid droplet ejection head relating to an embodiment of the present invention, and FIG. 2 is a partial enlarged view of same.

The liquid droplet ejection head 10 shown in FIGS. 1 and 2 is a print head used in an inkjet recording apparatus, for example. The liquid droplet ejection head 10 has a structure in which a plurality of ink chamber units 16, each comprising a nozzle 12 forming an ink ejection port, a pressure chamber 14 corresponding to the nozzle 12, and the like, (namely, liquid droplet ejection elements each forming a unit recording element corresponding to one nozzle) are arranged two-dimensionally in a staggered matrix configuration.

For the purpose of the description, in the matrix arrangement shown in the drawings, the horizontal direction in FIG. 1 is the row direction (the main scanning direction of a full line type inkjet recording apparatus described hereinafter), and the vertical direction in FIG. 1 is the column direction (the sub-scanning direction).

Figure 4:
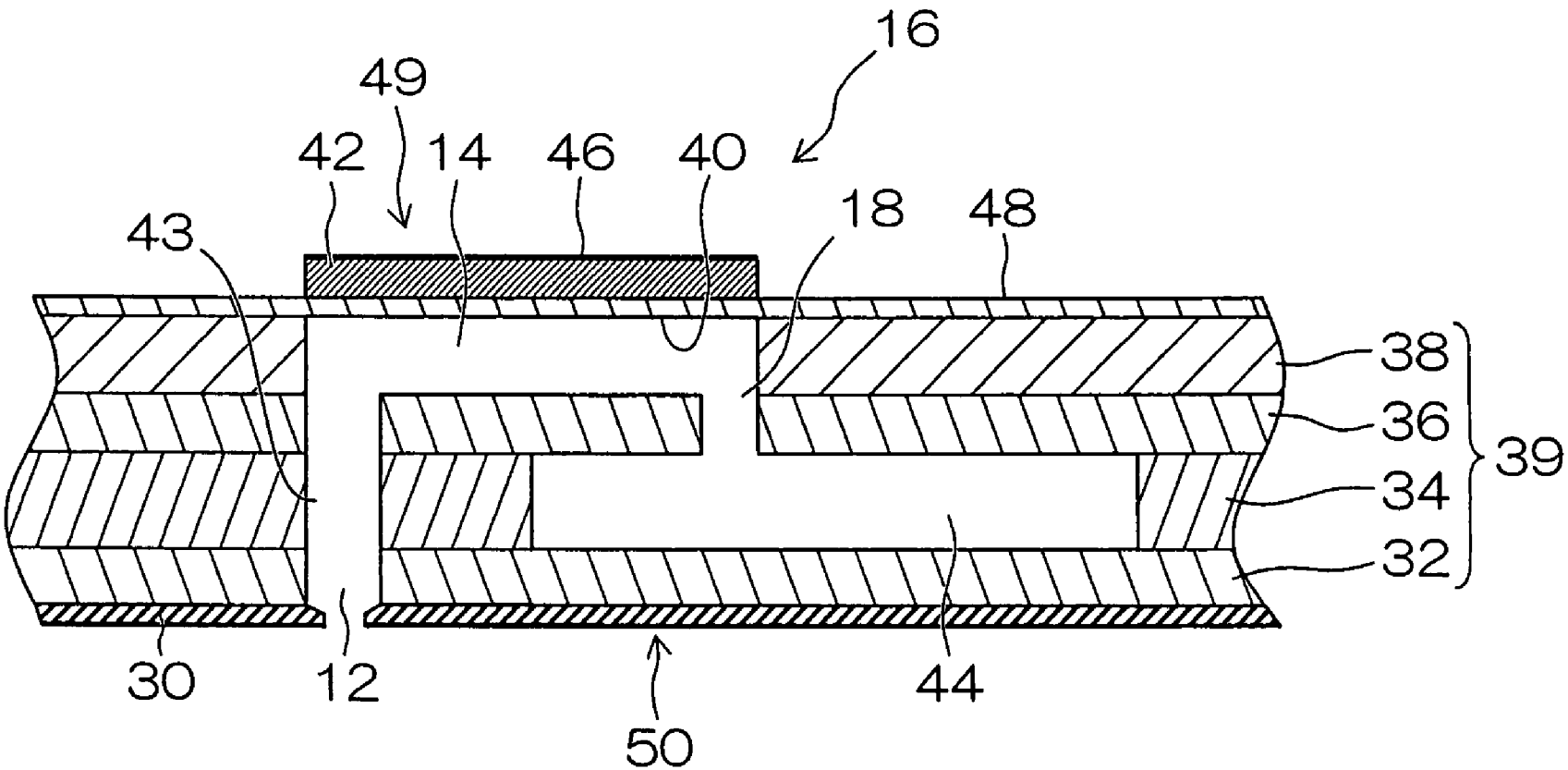
FIG. 4 is a cross-sectional diagram showing the three-dimensional structure of an ink chamber unit corresponding to one channel in a liquid droplet ejection head relating to an embodiment of the present invention.

The planar shape of the pressure chamber 14 provided corresponding to each nozzle 11 is substantially a square shape, and an outlet port to the nozzle 12 is provided at one of the ends of the diagonal line of the planar shape, while an inlet port (supply port) 18 for supplying ink (corresponding to a connection port to the common liquid chamber indicated by reference numeral 18 in FIG. 4) is provided at the other end thereof. The shape of the pressure chamber 14 is not limited to that of the present embodiment and various modes are possible in which the planar shape is a quadrilateral shape (such as diamond shape, rectangular shape, or the like), a pentagonal shape, a hexagonal shape, or other polygonal shape, or a circular shape, an elliptical shape, or the like.

As shown in FIG. 2, the liquid droplet ejection head 10 according to the present embodiment has a structure in which a plurality of ink chamber units 16 are arranged in a matrix configuration (an oblique lattice configuration) according to a fixed arrangement pattern following a row direction and an oblique column direction which is not perpendicular to the row direction (in FIG. 2, the column direction is a substantially longitudinal direction). By adopting this structure, a nozzle arrangement of high density is achieved.

More specifically, by adopting a structure in which a plurality of ink chamber units 16 are arranged at a uniform pitch d in line with the direction forming an angle of θ with respect to the main scanning direction (row direction), the pitch P of the nozzles projected to an alignment in the main scanning direction is "d×cos θ", and hence it is possible to treat the nozzles 12 as if they are arranged linearly at a uniform pitch of P. By means of this composition, it is possible to achieve a nozzle composition of high density, in which the nozzle columns projected to an alignment in the main scanning direction reach a total of 2400 per inch (2400 nozzles per inch).

To represent the two-dimensional arrangement in the drawings in a different manner, assuming a uniform value for the nozzle pitch, NLm, in the nozzle row of nozzles 12 aligned in the main scanning direction (row direction) (namely, assuming that the nozzle pitch in the main scanning direction is the same value of NLm in all of the rows), then the nozzles 12-*ij* of the respective rows are arranged in a staggered configuration by varying the nozzle positions in the main scanning direction, between each of the rows. In other words, taking the number of nozzle rows aligned in the main scanning direction of the two-dimensional nozzle arrangement (in other words, the number of nozzles in the sub-scanning direction) in the nozzle forming surface (ejection surface), to be n (in FIG. 2, n=6), and taking the effective nozzle pitch in the main scanning direction between nozzles which eject droplets to form dots aligned in the main scanning direction on the recording medium, to be P, then the relationship "NLm=n×P" is satisfied. Furthermore, the pitch Ls between rows in the sub-scanning direction (the column direction of the nozzle arrangement) (namely, the pitch between nozzles in the sub-scanning direction) is uniform.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 12 arranged in a matrix configuration shown in FIG. 2 are driven, it is desirable that main scanning is performed in accordance with (3) described above. In other words, taking the nozzles 12-11, 12-12, 12-13, 12-14, 12-15 and 12-16 as one block (and furthermore, taking nozzles 12-21, . . . , 12-26 as one block, and nozzles 12-31, . . . , 12-36 as one block), one line is printed in the breadthways direction of the recording medium by sequentially driving the nozzles 12-11, 12-12, . . . , 12-16 in accordance with the conveyance speed of the recording medium.

On the other hand, "sub-scanning" is defined as to repeatedly perform printing of one line (a line formed of a row of dots, or a line formed of a plurality of rows of dots) formed by the main scanning, while the full-line head and the recording medium are moved relatively to each other.

The direction indicated by one line (or the lengthwise direction of a band-shaped region) recorded by the main scanning as described above is called the "main scanning direction", and the direction in which sub-scanning is performed is called the "sub-scanning direction". In other words, in the present embodiment, the conveyance direction of the recording medium is called the sub-scanning direction and the direction perpendicular to same is called the main scanning direction.

According to the present invention, the arrangement of the nozzles is not limited to that of the embodiment illustrated. Furthermore, in the present embodiment, a composition is described in which six nozzle rows of nozzles 12 aligned in the row direction are arranged in the column direction, but in implementing the present invention, the number of nozzle rows, n, is not limited to this. However, in order to achieve high density, it is a prerequisite that n be an integer equal to or exceeding 3 (namely, that there be 3 or more nozzle rows).

Figure 3:
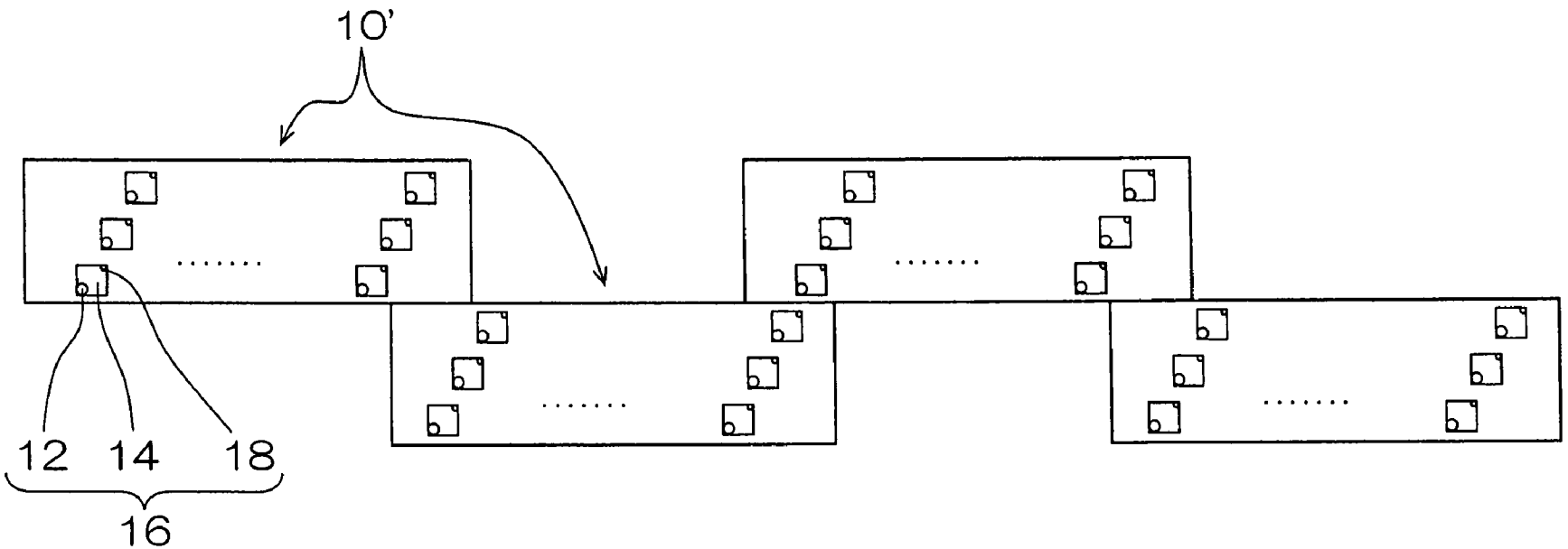
FIG. 3 is a plan diagram showing a further embodiment of the composition of a liquid droplet ejection head.

The mode of composing a full line head is not limited to the mode shown in FIG. 1 in which nozzle rows are formed through a length corresponding to the full width of the recording medium in the direction substantially perpendicular to the conveyance direction of the recording medium, by means of one head. For example, instead of the composition in FIG. 1, as shown in FIG. 3, a line head having nozzle rows of a length corresponding to the entire width of the recording medium can be formed by arranging and combining, in a staggered matrix, short head modules 10' each having a plurality of nozzles 12 arrayed in a two-dimensional fashion.

FIG. 4 is a cross-sectional diagram showing the three-dimensional structure of an ink chamber unit 16 corresponding to one channel of one liquid droplet ejection head 10.

As shown in FIG. 4, the ink chamber unit 16 (in other words, the liquid droplet ejection head 10) of the present embodiment is formed by superimposing together a plurality of plating members. The reference numeral 30 in FIG. 4 represents the nozzle plate, reference numerals 32 to 38 represent flow channel plates, 39 represents a flow channel substrate constituted by these flow channel plates 32 to 38, and 40 represents a diaphragm, 42 represents a piezoelectric body. Furthermore, a common liquid chamber 44, and the like, is formed in the space created in the flow channel plate 34.

Nozzle holes 12*a* forming nozzles 12 are pierced in the nozzle plate 30.

The flow channel plates 32 to 38 are members which are formed with ink flow channels of a desired shape, and the flow channel substrate 39 comprising a laminated body of the flow channel plates 32 to 38 creates spaces of the pressure chambers 14, connection channels (nozzle flow channels) 43 which connect the pressure chambers 14 to the nozzles 12, and supply channels 18 which direct ink from the common liquid chamber 44 to the pressure chambers 14.

A material (for example, polyimide) having a lower Young's modulus than metal is used for the diaphragm 40 which constitutes a portion of the ceiling faces of the pressure chambers 14. Thereby, it is possible to reduce the effects of the rigidity of the diaphragm on the ejection operation, and hence the ejection characteristics can be improved. Furthermore, a common electrode 48 for driving the piezoelectric bodies is formed on the upper surface of the diaphragm 40, in other words, on the surface on the opposite side from the pressure chambers 14.

The piezoelectric bodies 42 provided with the individual electrodes 46 are bonded to the upper surface of the common electrode 48, by means of a conductive adhesive, or the like. A piezoelectric material (such as lead titanate zirconate or barium titanate) is suitable for use as the piezoelectric bodies 42.

The piezoelectric actuators (piezoelectric elements) 49 each include an individual electrode 46, a common electrode 48 opposing same, and a piezoelectric body 42 interposed so as to be sandwiched between these electrodes. The individual electrodes for the piezoelectric elements, which each are provided with respect to each of the ink chamber units corresponding to each of the channels, are connected to a drive circuit (not illustrated) via wiring members (not illustrated), such as a flexible cable.

The common liquid chamber 44 is connected to the ink storing and loading unit forming the ink supply source (indicated by reference numeral 114 in FIG. 9), and the ink supplied from the ink storing and loading unit is distributed and supplied to each pressure chamber 14 by means of a common liquid chamber 44.

According to the ink chamber unit 16 having this composition, the piezoelectric body 42 is deformed by applying a drive voltage between the individual electrode 46 and the common electrode 48, the volume of the pressure chamber 14 is changed by driving the diaphragm 40, and ink is ejected from the nozzle 12 due to the subsequent pressure change. After ejection of the ink, new ink is supplied to the pressure chamber 14 by passing along the supply channel 18 from the common liquid chamber 44.

Figure 5:
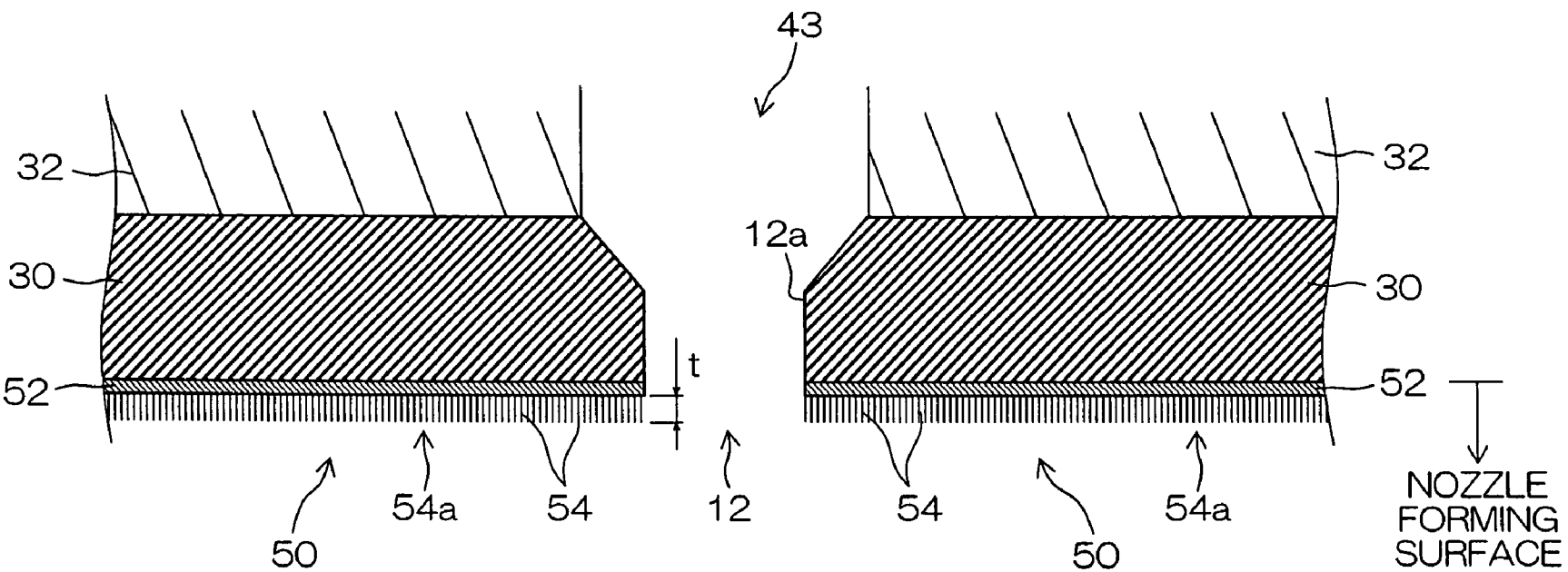
FIG. 5 is a cross-sectional diagram showing the detail structure of a nozzle plate relating to the present embodiment, by enlarging a portion of FIG. 4.

The nozzle plate 30 relating to the present embodiment is provided with a carbon nanotube layer 50 which forms a device for preventing adherence of liquid to the nozzle forming surface (the side of the ejection receiving medium, in other words, the surface on the side where the ink is ejected). The composition of the carbon nanotube layer 50 is described now with reference to FIG. 5. FIG. 5 is an enlarged diagram of the periphery of a nozzle 12 in the nozzle plate 30, and it shows the details of the carbon nanotube layer 50.

The carbon nanotube layer 50 includes a metal catalyst layer 52 and carbon nanotubes 54 precipitated to form a film on the metal catalyst layer 52.

As shown in FIG. 5, the metal catalyst layer 52 is formed in the portions of the nozzle forming surface of the nozzle plate 30 other than the nozzles 12 (portions where the nozzles 12 are not formed). It is possible to form a metal catalyst layer 52 only on the portions where the nozzles 12 are not formed by using patterning, such as vapor deposition or sputtering.

For the material of the metal catalyst layer 52, at least one of iron (Fe), nickel (Ni) and cobalt (Co), or a material containing these, is used. It is also possible to use a material including all of these elements: iron, nickel and cobalt.

Each of the individual carbon nanotubes 54 has low affinity with moisture, and hence they have liquid-repellency. The carbon nanotubes 54 are grown in an oriented fashion, to a length of several μm to several hundred μm (10 μm to 100 μm) from the surface of the metal catalyst layer 52, by means of a chemical vapor deposition method (CVD, such as plasma CVD and thermal CVD, etc.), using the metal catalyst layer 52 as a catalyst.

The chemical vapor deposition method is an industrial technique in which a chemical reaction is produced at the surface of a base material, a vapor deposition material is synthesized and deposited on the base material, and a thin film (of silicon, for example) is formed on the substrate. The fundamental reaction is based on contact between a volatile metal compound which evaporates at low temperature and a base material heated to a high temperature, and hence the target metal compound is precipitated onto the surface of the base material, thereby yielding a film surface. This reaction is used for the manufacture of a silicon oxide film, a silicon nitride film, an amorphous silicon thin film, or the like.

The mode of the metal catalyst layer 52 formed on the nozzle plate 30 is not limited to a case where the metal catalyst layer 52 and the carbon nanotubes 54 have the same thickness. However, it is desirable from the viewpoint of the liquid-repellency and the strength of the carbon nanotubes 54 to adjust the thickness t of the carbon nanotubes 54 appropriately.

In this way, by using the carbon nanotube layer 50 as a liquid-repellency layer, since the carbon nanotube layer has a structure in which a large number of carbon nanotubes are provided in a dense brush-like configuration, then the tensile strength of the boundary regions between the metal catalyst layer 52 and the carbon nanotubes 54 is extremely high with respect to impacts during wiping for example (namely, impacts which involve catching and pulling of the nozzle forming surface or the peripheral regions of the nozzles (holes) due to the friction of a wiping member), and hence detachment of the carbon nanotubes 54 can be prevented and very good wear characteristics (abrasion resistance properties) can be achieved. Furthermore, even if a bending stress is applied to each of the individual carbon nanotubes 54, the nanotubes restore their shape readily when the stress is removed, and hence impacts generated in the carbon nanotube layer 50 can be alleviated by the deformation of the plurality of carbon nanotubes 54, and consequently, mechanical impacts can also be absorbed.

Moreover, on the nano scale, there are differences between the lengths of the carbon nanotubes 54 (corresponding to the thickness t). Consequently, in the nozzle forming surface 54*a* (the surface formed by the group of the front tips of the carbon nanotubes), very slight undulations are formed on the nano scale. In addition to the intrinsic liquid-repellency of the carbon nanotubes themselves, the presence of the undulations in the nozzle forming surface 54*a* has the effect of further enhancing the liquid-repellency with respect to liquid on the nozzle forming surface.

Method for Manufacturing Liquid Droplet Ejection Head

Next, an example of a method of manufacturing a liquid droplet ejection head 10 and a nozzle plate 30 according to the present embodiment is described below. FIGS. 6A to 6F are manufacturing step diagrams which show a mode of implementing the method of manufacturing a liquid droplet ejection head 10, and FIG. 7 is a flowchart showing steps of forming a carbon nanotube layer in a nozzle plate 30.

Figure 6A:
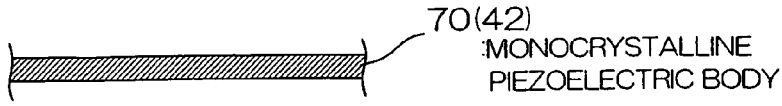
FIGS. 6A to 6F are diagrams showing steps for manufacturing a liquid droplet ejection head relating to an embodiment of the present invention.
Figure 7:
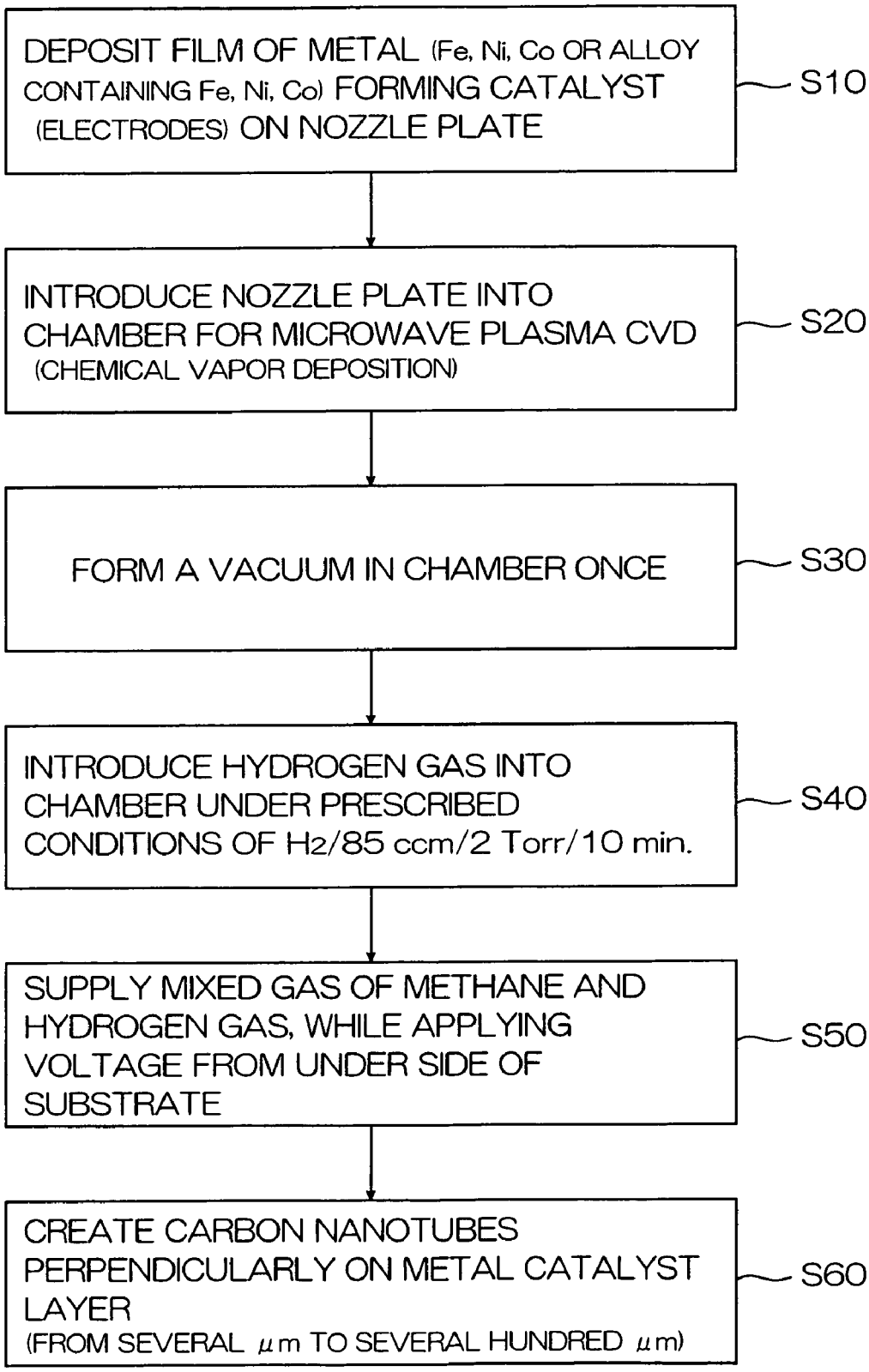
FIG. 7 is a flowchart showing steps for depositing a carbon nanotube layer on a nozzle plate relating to an embodiment of the present invention.

As shown in FIG. 6A, a monocrystalline piezoelectric body (bulk member) 70 which subsequently forms piezoelectric bodies 42 is prepared, and both the upper surface and the lower surface thereof are ground, thereby achieving a desired thickness dimension (several ten to one hundred μm).

Figure 6B:
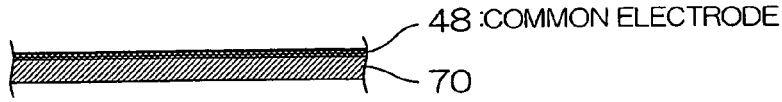

Next, as shown in FIG. 6B, a common electrode 48 of a metallic material (for example, gold (Au), platinum (Pt), or the like), is formed by sputtering onto the monocrystalline piezoelectric body 70. This common electrode 48 is patterned by the lift-off method, or the like.

Figure 6C:
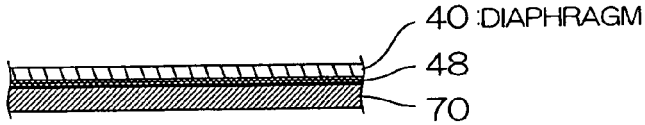

Next, a stainless steel (SUS 430) plate is attached by adhesive to the common electrode 48, as a diaphragm 40 (FIG. 6C). The material of the diaphragm is not limited to SUS 430, and polyimide, or the like, may also be used properly.

Figure 6D:
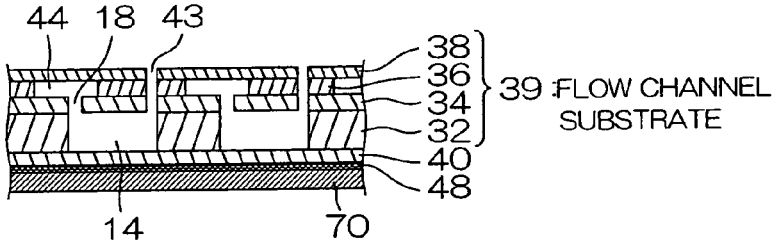

As shown in FIG. 6D, flow channel plates 32 to 38, which are SUS substrates, are superimposed onto the structure comprising the monocrystalline piezoelectric body 70, the common electrode 48 and the diaphragm 40 obtained in this way, and are bonded together by means of a commonly known adhesive. Pressure chambers 14, connection channels 43, supply channels 18 and a common liquid chamber 44, are formed previously in the flow channel plates 32 to 38 by means of an etching process, a dicing processing, or the like, so as to have prescribed shapes corresponding to their arrangement positions and functions. Accordingly, a flow channel substrate 39 constituting a flow channel structure comprising pressure chambers 14, connection channels 43, supply channels 18 and a common liquid chamber 44 is formed.

Figure 6E:
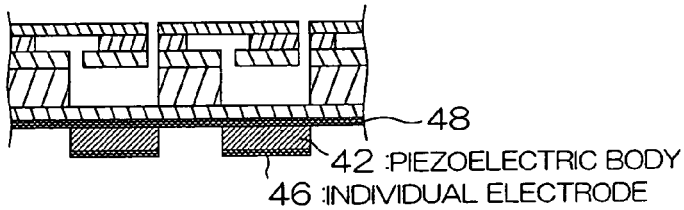

Subsequently, the monocrystalline piezoelectric body 70 is patterned to form sizes corresponding to the pressure chambers 14, and thereby piezoelectric bodies 42 are formed on the common electrode 48 (FIG. 6E). This patterning is carried out by dry etching, sandblasting or the like. Individual electrodes 46 made of platinum are formed by the lift-off method, or the like, onto the piezoelectric bodies 42 obtained by the patterning step, respectively.

Here, before the step of installing the nozzle plate 30 onto the flow channel substrate 39, a carbon nanotube layer 50 is deposited onto the nozzle plate 30.

Firstly, as shown in step S110 in FIG. 7, a metal which form a catalyst (electrode) for the carbon nanotubes, is deposited onto the nozzle plate 30. There are no particular restrictions of this film deposition method, and vapor deposition, sputtering, or the like, may be used.

Figure 8:
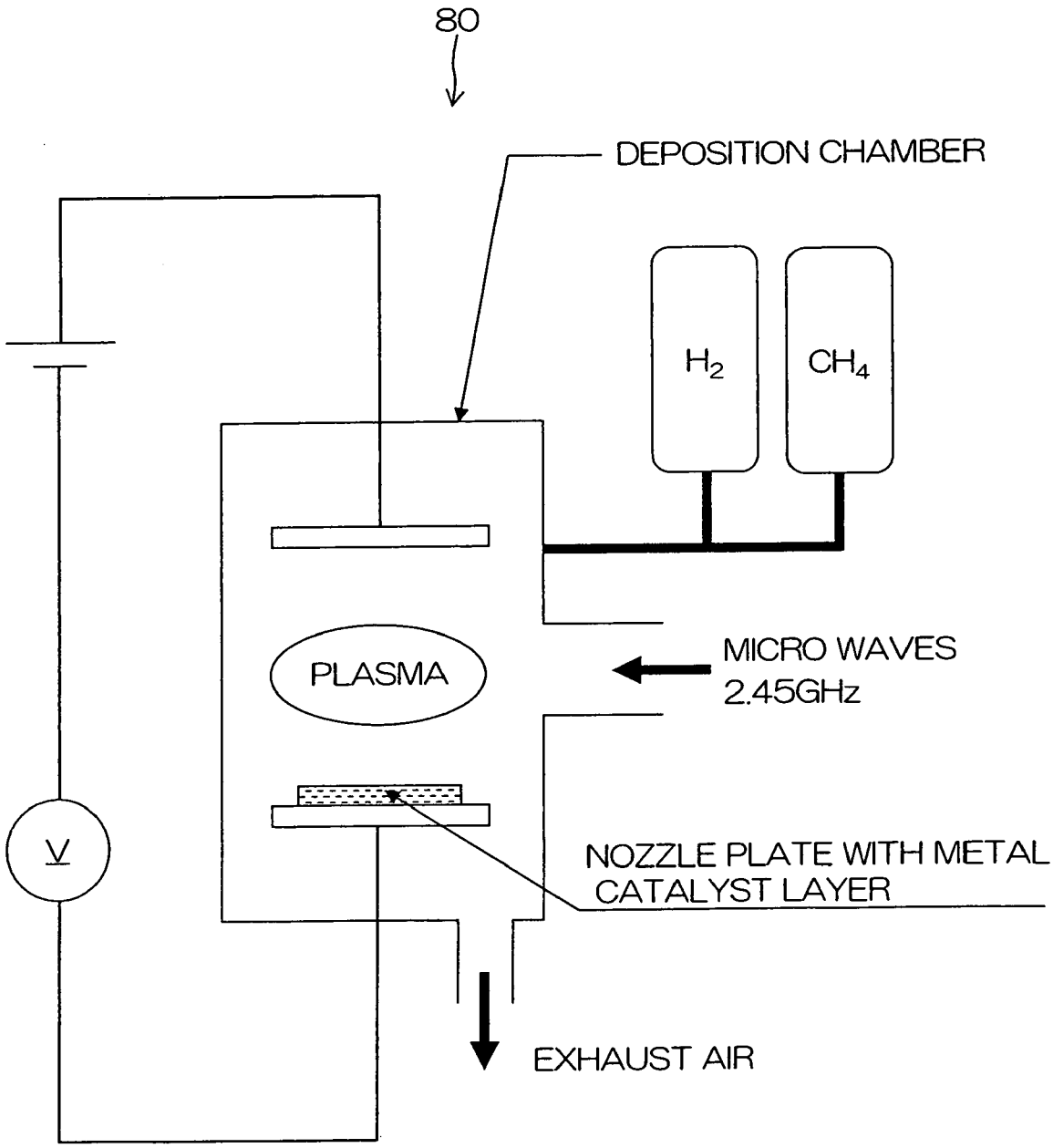
FIG. 8 is a diagram showing the composition of a microwave plasma CVD chamber used for forming a carbon nanotube layer.

Next, at step S20, the nozzle plate 30 on which the metal catalyst layer has been deposited is introduced into a chamber for microwave plasma CVD (chemical vapor deposition method). FIG. 8 is a structural schematic drawing showing this chamber 80, and 2.45 GHz microwaves are used in this chamber.

Next, the interior of the chamber 80 is once reduced to a vacuum by expelling the air inside the chamber 80 (step S30 in FIG. 7), and as a pre-treatment, hydrogen gas is introduced into the chamber 80 under conditions of $H_2$/85 ccm/2 Torr/10 Min. (step S40 in FIG. 7).

Moreover, while a voltage is applied from below the substrate (in the present embodiment, the nozzle plate), a mixed gas of methane and hydrogen is supplied to the chamber 80 (step S50 in FIG. 7).

By so doing, carbon nanotubes are generated on the metal catalyst layer of the nozzle plate. Consequently, a carbon nanotube layer 50 is deposited on the surface of the nozzle plate 30, as shown in FIG. 5.

In particular, since the carbon nanotubes grow only on the metal catalyst layer, it is possible to deposit the carbon nanotube layer by the self-alignment function, after the openings of the nozzles is formed in the nozzle plate. Consequently, compared to the steps up to the formation of the liquid-repellency layer in the related art, a liquid-repellency layer, and more specifically, a carbon nanotube layer 50, can be deposited regardless of the shape of the nozzle plate or the positions in which the nozzles are formed in the nozzle plate. Therefore, the freedom of design of the process for forming the liquid-repellency layer is improved.

Here, in the liquid-repellency layer of the related art, the undulating structure formed on the surface of the liquid-repellency layer in order to improve liquid-repellency requires, for example, a photo-process for applying undulations after the formation of the film. In other words, the undulating structure in the related art requires, for example, photo-deposition after the deposition of the liquid-repellency layer, and an ultrafine process such as an ultra-fine etching process which is carried out after the photo-process. However, according to the carbon nanotube layer described in the present embodiment, it is possible to deposit a structure having undulations, without the need for an ultrafine processing, or the like, and therefore the forming process is simplified compared to the liquid-repellency layer of the related art.

Figure 6F:
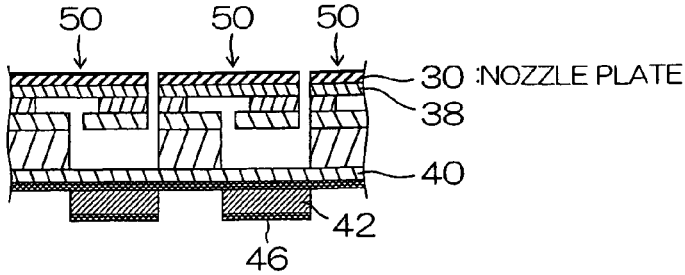

In a procedure of this kind, as shown in FIG. 6F, a nozzle plate 30 formed with a carbon nanotube layer 50 is bonded by adhesive to a surface of the flow channel plate 38 which is located across the flow channel plate 38 from the diaphragm 40, thereby completing the liquid droplet ejection head 10 shown in FIG. 4.

In this case, the nozzle plate 30 is bonded while the pressure chambers 14 are connected with the nozzles 12 by means of the connecting channels 43. In particular, when the nozzle plate 30 is bonded, it is possible to adopt a commonly known technique similar to that used when a flow channel plate of stainless steel (SUS) is bonded, such as a transfer method by which an adhesive is formed uniformly over the whole surface of the nozzle plate 30 in such a manner that the connection channels 43 in the flow channel substrate 39 and the nozzles 12 in the nozzle plate 30 are not sealed off.

Here, the carbon nanotube layer 50 in the nozzle plate 30 is deposited over the whole surface of the nozzle plate 30, but it is not limited to this. It is also possible to restrict the deposition of this layer to the peripheral regions of the openings of the nozzles 12 only.

The composition of the liquid droplet ejection head 10 relating to the present invention is not limited to that described above. For example, in the present embodiment, piezoelectric bodies 42 are used, which change the volume of the pressure chambers 14 by bending and deforming the diaphragm 40 of the pressure chambers 14 in accordance with a drive signal; however, the present invention can also be applied to liquid droplet ejection heads in which heating bodies (heaters) are used instead of these piezoelectric bodies 42. In other words, the present invention can also be applied to liquid droplet ejection heads having a composition in which pressure chambers 14 are heated by passing current through heating bodies, thus air bubbles are generated in the ink inside the pressure chambers which change the volume of the pressure chambers 14, and ink is ejected from the nozzles by the pressure change created by this volume change.

Furthermore, a composition is described here in which nozzle holes 12*a* are pierced in the nozzle plate 30 prior to the deposition of the carbon nanotube layer 50, but the invention is not limited to this, and a mode where nozzle holes 12*a* are pierced after the formation of the carbon nanotube layer 50 is also possible.

Embodiment of Application to Inkjet Recording Apparatus

The nozzle plate and liquid droplet ejection head according to the embodiment described above is, for example, used in an inkjet head (print head) installed in an inkjet recording apparatus which forms an image forming apparatus.

Figure 9:
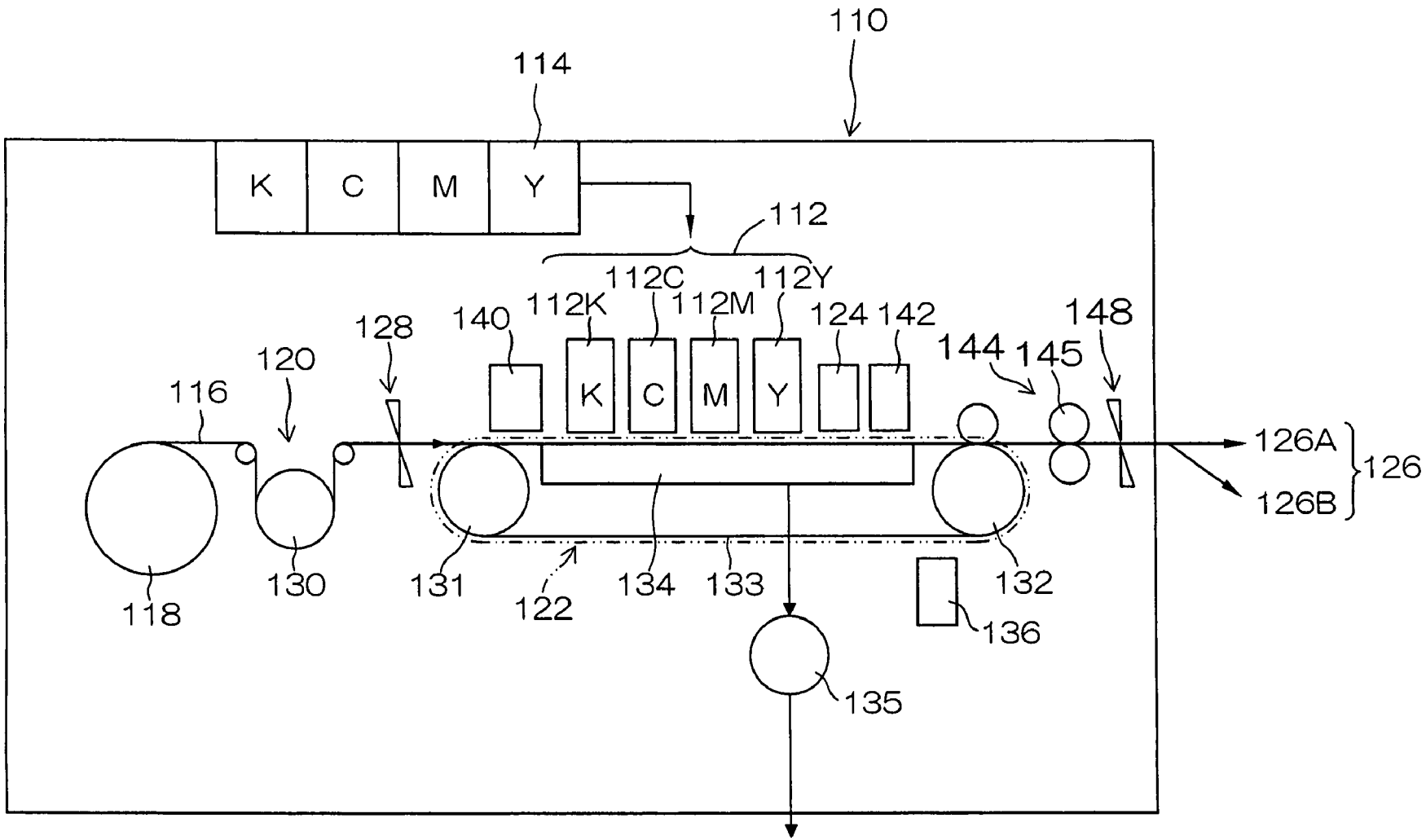
FIG. 9 shows a general schematic drawing of one embodiment of an inkjet recording apparatus which uses a nozzle plate and liquid droplet ejection head according to an embodiment of the present invention.

FIG. 9 shows a general schematic drawing of one embodiment of an inkjet recording apparatus which uses a nozzle plate and liquid droplet ejection head according to the present invention. As shown in FIG. 9, the inkjet recording apparatus 110 comprises: a print unit 112 having a plurality of inkjet recording heads (hereinafter, called heads) 112K, 112C, 112M, and 112Y provided for ink colors of black (K), cyan (C), magenta (M), and yellow (Y), respectively; an ink storing and loading unit 114 for storing inks to be supplied to the heads 112K, 112C, 112M and 112Y; a paper supply unit 118 for supplying recording paper 116 forming a recording medium; a decurling unit 120 for removing curl in the recording paper 116; a belt conveyance unit 122, disposed facing the nozzle face (ink ejection face) of the print unit 112, for conveying the recording paper 116 while keeping the recording paper 116 flat; a print determination unit 124 for reading the printed result produced by the print unit 112; and a paper output unit 126 for outputting recorded recording paper (printed matter) to the exterior.

The liquid droplet ejection heads 10 having the composition shown in FIGS. 1 to 5 are used respectively for the heads 112K, 112C, 112M, and 112Y of the print unit 112. Furthermore, the nozzle plate 30 having the composition shown in FIGS. 1 to 5 is installed in each of the heads 112K, 112C, 112M, and 112Y.

The ink storing and loading unit 114 has ink tanks for storing the inks of K, C, M and Y to be supplied to the heads 112K, 112C, 112M, and 112Y, and the tanks are connected to the heads 112K, 112C, 112M, and 112Y by means of prescribed channels. The ink storing and loading unit 114 has a warning device (for example, a display device or an alarm sound generator) for warning when the remaining amount of any ink is low, and has a mechanism for preventing loading errors among the colors.

In FIG. 9, a magazine for rolled paper (continuous paper) is shown as an embodiment of the paper supply unit 118; however, a plurality of magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording medium (media) can be used, it is preferable that an information recording medium such as a bar code and a wireless tag containing information about the type of media is attached to the magazine, and by reading the information contained in the information recording medium with a predetermined reading device, the type of recording medium to be used (type of media) is automatically determined, and ink-droplet ejection is controlled so that the ink-droplets are ejected in an appropriate manner in accordance with the type of media.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 9, and the continuous paper is cut into a desired size by the cutter 128. When cut papers are used, the cutter 128 is not required.

The decurled and cut recording paper 116 is delivered to the belt conveyance unit 122. The belt conveyance unit 122 has a configuration in which an endless belt 133 is set around rollers 131 and 132 so that the portion of the endless belt 133 facing at least the nozzle face of the printing unit 112 and the sensor face of the print determination unit 124 forms a horizontal plane (flat plane).

The belt 133 has a width that is greater than the width of the recording paper 116, and a plurality of suction apertures (not shown) are formed on the belt surface. A suction chamber 134 is disposed in a position facing the sensor surface of the print determination unit 124 and the nozzle surface of the printing unit 112 on the interior side of the belt 133, which is set around the rollers 131 and 132, as shown in FIG. 9. The suction chamber 134 provides suction with a fan 135 to generate a negative pressure, and the recording paper 116 is held on the belt 133 by suction. It is also possible to use an electrostatic attraction method, instead of a suction-based attraction method.

The belt 133 is driven in the clockwise direction in FIG. 9 by the motive force of a motor (not shown) being transmitted to at least one of the rollers 131 and 132, which the belt 133 is set around, and the recording paper 116 held on the belt 133 is conveyed from left to right in FIG. 9.

Since ink adheres to the belt 133 when a marginless print job or the like is performed, a belt-cleaning unit 136 is disposed in a predetermined position (a suitable position outside the printing area) on the exterior side of the belt 133. Although the details of the configuration of the belt-cleaning unit 136 are not shown, embodiments thereof include a configuration in which the belt 133 is nipped with cleaning rollers such as a brush roller and a water absorbent roller, an air blow configuration in which clean air is blown onto the belt 133, or a combination of these. In the case of the configuration in which the belt 133 is nipped with the cleaning rollers, it is preferable to make the line velocity of the cleaning rollers different than that of the belt 133 to improve the cleaning effect.

The inkjet recording apparatus 110 can comprise a roller nip conveyance mechanism, instead of the belt conveyance unit 122. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 140 is disposed on the upstream side of the printing unit 112 in the conveyance pathway formed by the belt conveyance unit 122. The heating fan 140 blows heated air onto the recording paper 116 to heat the recording paper 116 immediately before printing so that the ink deposited on the recording paper 116 dries more easily.

The heads 112K, 112C, 112M and 112Y of the printing unit 112 are full line heads having a length corresponding to the maximum width of the recording paper 116 used with the inkjet recording apparatus 110, and comprising a plurality of nozzles for ejecting ink arranged on a nozzle face (nozzle forming face) through a length exceeding at least one edge of the maximum-size recording medium (namely, the full width of the printable range).

The print heads 112K, 112C, 112M and 112Y are arranged in color order (black (K), cyan (C), magenta (M), yellow (Y)) from the upstream side in the feed direction of the recording paper 116, and these respective heads 112K, 112C, 112M and 112Y are fixed extending in a direction substantially perpendicular to the conveyance direction of the recording paper 116.

A color image can be formed by ejecting inks of different colors from the heads 112K, 112C, 112M and 112Y, respectively, onto the recording paper 116 while the recording paper 116 is conveyed by the belt conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation (one sub-scanning operation) of relatively moving the recording paper 116 and the printing unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY standard colors (four colors) is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 124 illustrated in FIG. 9 has an image sensor (line sensor or area sensor) for capturing an image of the droplet ejection result of the print unit 112, and functions as a device which measures the dependency relationships between dots and the dot displacement amounts, on the basis of the image of ejected droplets read in by the image sensor, as well as functioning as a device which checks for ejection defects, such as blockages, landing position displacement, and the like, of the nozzles. A test pattern or the target image printed by the print heads 112K, 112C, 112M, and 112Y of the respective colors is read in by the print determination unit 124, and the ejection performed by each head is determined. The ejection determination includes the presence of the ejection, measurement of the dot size, and measurement of the dot deposition position.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 9, the paper output unit 126A for the target prints is provided with a sorter for collecting prints according to print orders.

In the present embodiment, an inkjet recording apparatus having a full line type head is described, but the scope of application of the present invention is not limited to this. For example, the present invention may also be applied to a case where images are formed by using a head of a length which is shorter than the width dimension of the recording medium (the recording paper 116 or other print media), and scanning the head a plurality of times, as in a shuttle scanning method.

Moreover, in the foregoing explanation, an inkjet recording apparatus is described as an image forming apparatus, but the scope of application of the present invention is not limited to this. For example, the nozzle plate and the liquid droplet ejection head according to the present invention may also be applied to a photographic image forming apparatus having a liquid droplet ejection head which applies developing solution, or the like, onto a printing paper by means of a non-contact method. Furthermore, the scope of application of the present invention is not limited to an image forming apparatus, and the present invention may also be applied to various other types of apparatuses which spray a processing liquid, or other liquid, toward an ejection receiving medium by means of a nozzle plate and liquid droplet ejection head (such as, a coating apparatus, an application apparatus, a wiring pattern printing apparatus, or the like).

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A nozzle plate comprising:

a nozzle through which liquid is ejected;

a nozzle forming surface in which the nozzle is provided; and a liquid-repellency layer which is provided on the nozzle forming surface, the liquid-repellency layer including a carbon nanotube layer.

2. The nozzle plate as defined in claim 1, wherein the carbon nanotube layer is deposited by chemical vapor deposition of carbon nanotubes on a metal catalyst layer including at least one of iron, nickel and cobalt.

3. A method of manufacturing a nozzle plate comprising a nozzle through which liquid is ejected and a nozzle forming surface in which the nozzle is provided, the method comprising the steps of:

forming a metal catalyst layer on the nozzle forming surface of the nozzle plate; and depositing carbon nanotubes by chemical vapor deposition, onto the metal catalyst layer.

4. The method of manufacturing a nozzle plate as defined in claim 3, wherein the metal catalyst layer is formed selectively in a section where the nozzle is not formed on the nozzle forming surface of the nozzle plate.

5. A liquid droplet ejection head comprising a nozzle plate, wherein the nozzle plate includes: a nozzle through which liquid is ejected; a nozzle forming surface in which the nozzle is provided; and a liquid-repellency layer which is provided on the nozzle forming surface, the liquid-repellency layer including a carbon nanotube layer.

6. The liquid droplet ejection head as defined in claim 5, wherein the carbon nanotube layer is deposited by chemical vapor deposition of carbon nanotubes on a metal catalyst layer including at least one of iron, nickel and cobalt.

7. A method of manufacturing a liquid droplet ejection head comprising a nozzle plate including a nozzle through which liquid is ejected and a nozzle forming surface in which the nozzle is provided, the method comprising the steps of:

forming a metal catalyst layer on the nozzle forming surface of the nozzle plate; and depositing carbon nanotubes by chemical vapor deposition, onto the metal catalyst layer.

8. The method of manufacturing a liquid droplet ejection head as defined in claim 7, wherein the metal catalyst layer is formed selectively in a section where the nozzle is not formed on the nozzle forming surface of the nozzle plate.

9. The method of manufacturing a liquid droplet ejection head as defined in claim 7, the method further comprising a step of bonding the nozzle plate to a substrate including a pressure chamber in such a manner that the pressure chamber is connected with the nozzle.

10. An image forming apparatus comprising a liquid droplet ejection head including a nozzle plate, wherein the nozzle plate comprises: a nozzle through which liquid is ejected; a nozzle forming surface in which the nozzle is provided; and a liquid-repellency layer which is provided on the nozzle forming surface, the liquid-repellency layer including a carbon nanotube layer.

* * * * *